United States Patent [19]

Akasaka et al.

[11] Patent Number: 5,040,499

[45] Date of Patent: Aug. 20, 1991

[54] INTAKE- AND/OR EXHAUST-VALVE TIMING CONTROL SYSTEM FOR INTERNAL COMBUSTION ENGINES

[75] Inventors: Akio Akasaka; Seiji Suga, both of Kanagawa, Japan

[73] Assignee: Atsugi Unisia Corporation, Kanagawa, Japan

[21] Appl. No.: 483,633

[22] Filed: Feb. 23, 1990

[30] Foreign Application Priority Data

Feb. 28, 1989 [JP] Japan ..... 1-48814

[51] Int. Cl.[5] ..... F01L 1/34

[52] U.S. Cl. ..... 123/90.17; 123/90.31

[58] Field of Search ..... 123/90.12, 90.15, 90.17, 123/90.31

[56] References Cited

U.S. PATENT DOCUMENTS

| | | | |
|---|---|---|---|
| 4,231,330 | 11/1980 | Garcea | 123/90.15 |
| 4,421,074 | 12/1983 | Garcea et al. | 123/90.15 |
| 4,811,698 | 3/1989 | Akasaka et al. | 123/90.31 |
| 4,856,465 | 8/1989 | Denz et al. | 123/90.17 |
| 4,862,843 | 9/1989 | Kawamoto et al. | 123/90.17 |

FOREIGN PATENT DOCUMENTS

| | | | |
|---|---|---|---|
| 0340821 | 11/1989 | European Pat. Off. | 123/90.17 |
| 0003111 | 1/1987 | Japan | 123/90.17 |
| 0003112 | 1/1987 | Japan | 123/90.17 |
| 2120320 | 11/1983 | United Kingdom | 123/90.17 |

*Primary Examiner*—David A. Okonsky
*Assistant Examiner*—Weilun Lo
*Attorney, Agent, or Firm*—Ronald P. Kananen

[57] ABSTRACT

An intake- and/or exhaust-valve timing control system for internal combustion engines comprises a timing pulley including inner and outer gears, a camshaft including an outer gear and a ring gear disposed between the pulley and the camshaft for varying the phase angle between the camshaft and the pulley. The ring gear includes inner and outer gears respectively meshed with the outer gear of the camshaft and the inner gear of the pulley. At least one of the two meshing pairs of gears is helical. The outer gear of the pulley has a first number of teeth and the outer gear of the camshaft or the ring gear has a second number of teeth different from the first number, and a combination of the first and second numbers is selected in such a manner as to satisfy an inequaltiy $|dO+n(360°/M)| \leqq |T|$, wherein dO is an offset angle of intake- and/or exhaust-valve timing of the engine in a state wherein the pulley, the camshaft and the ring gear are temporarily assembled, n is an integer, M is the least common multiple between the first and second numbers, and T is a predetermined tolerance for valve timing.

9 Claims, 2 Drawing Sheets

INTAKE- AND/OR EXHAUST-VALVE TIMING CONTROL SYSTEM FOR INTERNAL COMBUSTION ENGINES

BACKGROUND OF THE INVENTION

1. Field of the Invention

The present invention relates to an intake- and/or exhaust-valve timing control system which is optimally, adapted for use in internal combustion engines. More particularly, the invention relates to a system which is variably capable of controlling intake- and/or exhaust-valve timing depending on the operating state of the engine, for example, the magnitude of engine load and/or engine speed.

2. Description of the Prior Disclosure

Recently, there have been proposed and developed various intake- and/or exhaust-valve timing control systems for internal combustion engines for generating optimal engine performance according to the operating state of a vehicular engine.

As is generally known, valve timing is usually determined such that optimal engine performance is obtained; however, a predetermined valve timing is not suitable under all operating conditions. For example, when an engine is operating within a range of low revolutions, higher torque will be obtained with an intake-valve timing earlier than with a fixed, predetermined valve timing.

Such a conventional intake- and/or exhaust-valve timing control system for internal combustion engines has been disclosed in U.S. Pat. No. 4,231,330. In this conventional valve timing control system, a cam sprocket having a driven connection with an engine crankshaft is rotatably supported through a ring gear mechanism at a front end of the camshaft. The ring gear mechanism includes a ring gear having an inner toothed portion engaging another toothed portion formed on the front end of the camshaft and an outer toothed portion engaging an inner toothed portion formed on the inner peripheral wall of the cam sprocket. In this manner, the ring gear rotatably engages between the cam sprocket and the camshaft. The ring gear is normally biased in the axial direction of the camshaft by spring means, such as a coil spring. At least one of the two meshing pairs of gears is helical. The result is that axial sliding movement of the ring gear relative to the camshaft causes the camshaft to rotate about the cam sprocket and therefore the phase angle between the camshaft and cam sprocket (and consequently, the phase angle between the camshaft and the engine crankshaft) is varied relatively. The ring gear moves as soon as one of the two opposing forces acting on it, namely the preloading pressure of the above spring means or the oil pressure applied from the oil pump through the flow control valve to the ring gear, exceeds the other. The conventional valve timing control system also includes an end disc locked on the front end of the camshaft by threading such that the end disc hermetically closes the front opening of the substantially cylindrical cam sprocket in an air-tight fashion. As is well known, when a crankshaft is connected through a timing chain or a timing belt to a camshaft, the phase angle between the crankshaft and the camshaft must be set to a predetermined value to obtain desirable valve timing. For this reason, timing marks may be indicated on the crank sprocket, the timing chain, and/or the cam sprocket for instance. However, in the conventional valve timing system as described, when the end disc is screwed into the inner threaded portion formed in the center of the front end of the camshaft, the relative phase angle relationship between the cam sprocket and the camshaft is varied and as a result, the phase angle between the crankshaft and the camshaft is offset from the predetermined phase angle as well. Therefore, the phase angle between the camshaft and the cam sprocket must be adjusted after threading the end disc into the front end of the camshaft. Furthermore, in conventional valve timing control systems, the relative phase angle between the inner and outer toothed portions of the ring gear is not always set to a particular value. That is, the inner toothed portion of the ring gear is independently formed irrespective of the phase angle of the outer toothed portion. Consequently, in conventional valve timing control systems, phase angle adjustments are troublesome and time consuming.

SUMMARY OF THE INVENTION

It is, therefore, in view of the above disadvantages, an object of the present invention to provide an intake- and/or exhaust-valve timing control system for internal combustion engines, in which the phase angle between a timing pulley (or cam sprocket) and a camshaft, that is the preset intake- and/or exhaust-valve timing relative to the crank angle, is easily and precisely adjusted within a range of a predetermined tolerance.

In order to accomplish the aforementioned and other objects, an intake- and/or exhaust-valve timing control system for an internal combustion engine comprises a substantially cylindrical rotating member having a driven connection with a crankshaft of the engine through an outer toothed portion employed at the outer peripheral surface thereof, the outer toothed portion having a first number of teeth, the rotating member including an inner toothed portion at the inner peripheral surface thereof, a camshaft including an outer toothed portion having a second number of teeth, different from the first number, at the outer peripheral surface thereof, a ring gear member disposed between the camshaft and the rotating member for varying the phase angle between the camshaft and the rotating member. The ring gear member includes inner and outer toothed portions being respectively meshed with the outer toothed portion of the camshaft and the inner toothed portion of the rotating member. At least one of the two meshing pairs of toothed portions is helical to provide an axial sliding movement of the ring gear member relative to the camshaft. A combination of the first and second numbers is selected in such a manner as to satisfy the following inequality.

$$|dO + n(360°/M)| \leqq |T|$$

wherein dO is an offset angle of intake- and/or exhaust-valve timing of the engine in a state wherein the rotating member, the camshaft and the ring gear member are temporarily assembled, n is an integer, M is the least common multiple between the first and second numbers of teeth, and T is a predetermined tolerance of the intake- and/or exhaust-valve timing.

According to another aspect of the invention, an intake- and/or exhaust-valve timing control system for an internal combustion engine comprises, a substantially cylindrical rotating member having a driven connection with a crankshaft of the engine through an outer toothed portion employed at the outer peripheral surface thereof, the outer toothed portion having a first number of teeth, the rotating member including an inner toothed portion at the inner peripheral surface thereof, a camshaft including an outer toothed portion at the outer peripheral surface thereof, a ring gear member disposed between the camshaft and the rotating member for varying the phase angle between the camshaft and the rotating member. The ring gear member includes inner and outer toothed portions being respectively meshed with the outer toothed portion of the camshaft and the inner toothed portion of the rotating member. At least one of the two meshing pairs of toothed portions is helical to provide an axial sliding movement of the ring gear member relative to the camshaft. The outer toothed portion of the ring gear member has a second number of teeth different from the first number. A combination of the first and second numbers is selected in such a manner as to satisfy the following inequality.

$$|dO+n(360°/M)| \leqq |T|$$

wherein dO is an offset angle of intake- and/or exhaust-valve timing of the engine in a state wherein the rotating member, the camshaft and the ring gear member are temporarily assembled, n is an integer, M is the least common multiple between the first and second numbers of teeth, and T is a predetermined tolerance for the intake- and/or exhaust-valve timing.

It is desirable that at least one of the first and second numbers is a prime number. The intake- and/or exhaust-valve timing control system according to the invention further comprises a ring gear drive mechanism for drivingly controlling the ring gear member via oil pressure depending upon the operating state of the engine.

DESCRIPTION OF THE PREFERRED EMBODIMENT

Figure 1:
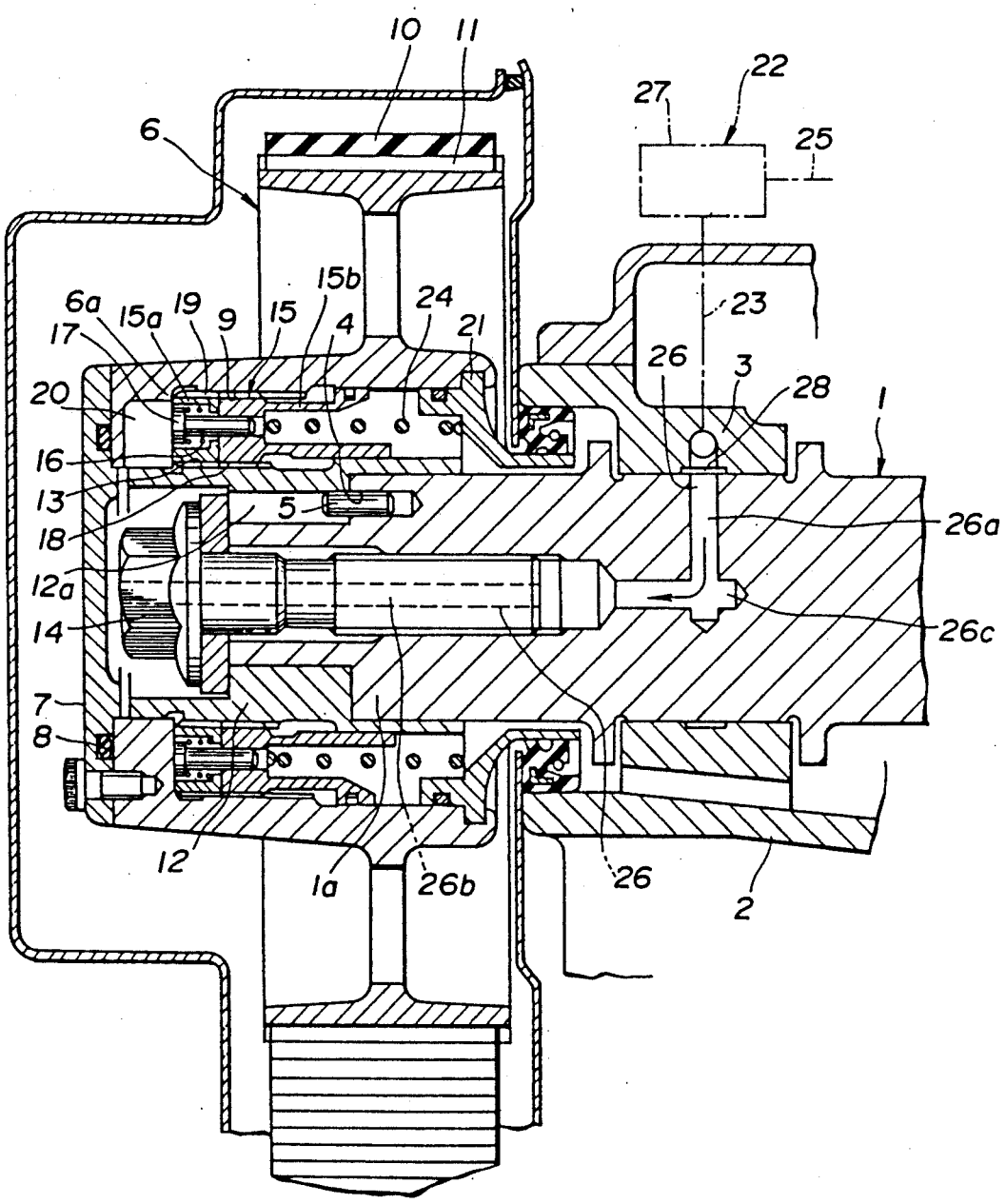
FIG. 1 is a cross sectional view illustrating an intake- and/or exhaust-valve timing control system of an embodiment according to the invention.
Figure 2:
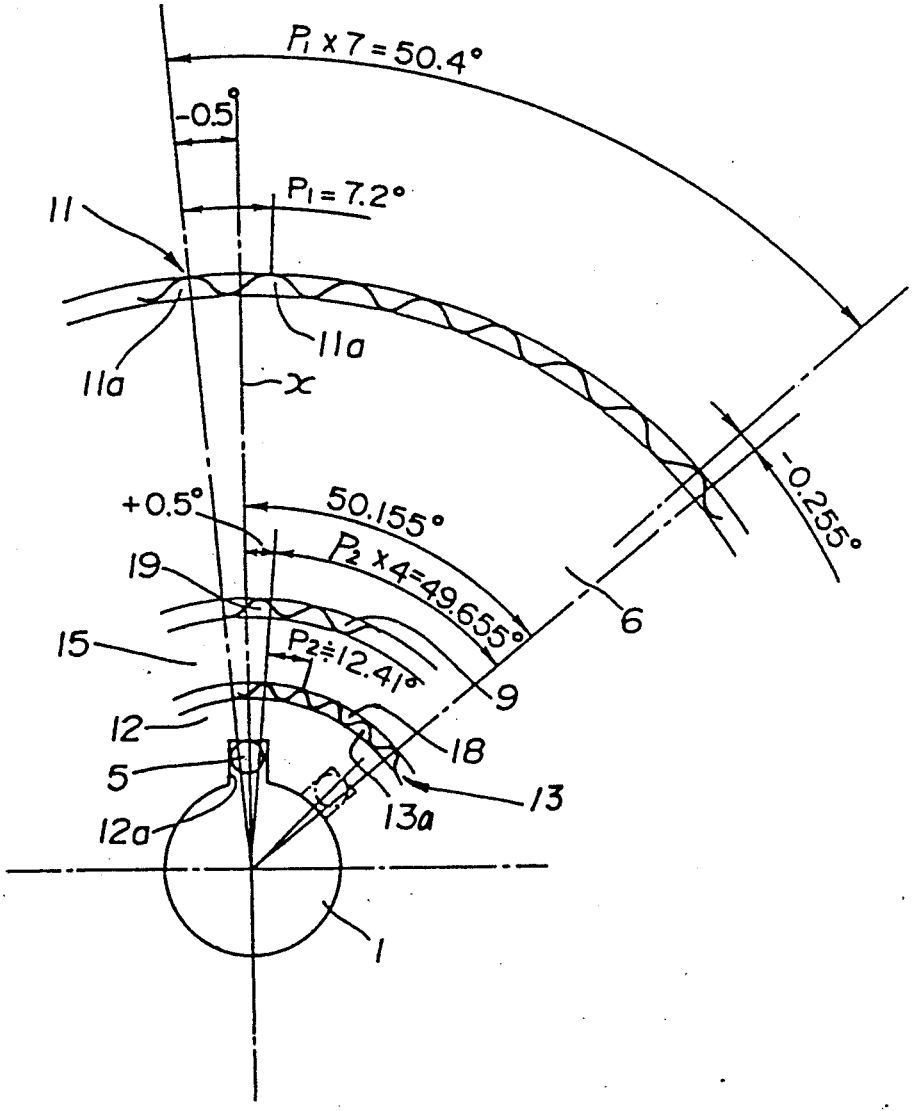
FIG. 2 is a drawing explaining a phase angle adjusting method of the valve timing control system according to the invention wherein the phase angle between the camshaft and the cam sprocket (or timing pulley) is set to a predetermined value to obtain desirable valve timing.

The principles of the present invention as applied to intake- and/or exhaust valve timing control systems for internal combustion engines are illustrated in FIGS. 1 and 2.

FIG. 1 shows a front end section of a camshaft 1 provided for opening and/or closing an intake- and/or exhaust-valve (not shown). As clearly seen in FIG. 1, the camshaft 1 is journaled by a cylinder head 2 and a bearing member 3. Reference numeral 6 denotes a timing pulley having an outer gear 11 driven by a timing belt 10 for transmitting torque from an engine crankshaft. A front lid 7 is fitted through a seal ring 8 into the front end of the substantially annular hub of the timing pulley 6 in an air tight fashion. The pulley 6 also includes an inner gear 9 at the inner peripheral surface thereof. A sleeve 12 having an outer gear 13 is firmly connected to the outer peripheral surface of the front end 1*a* of the camshaft 1 by a bolt 14 and a knock pin 5. The pin 5 is press-fitted into a knock pin hole 4 axially bored in the front end of the camshaft 1. A portion of the pin 5 is exposed from the knock pin hole 4 in such a manner as to engage an engaging groove 12*a* axially formed in the sleeve 12. For this reason, the groove 12*a* has a groove width essentially equal to the outer diameter of the pin 5 to provide an accurate positioning between the camshaft 1 and the sleeve 12.

A ring gear mechanism is provided between the timing pulley 6 and the sleeve 12. The ring gear mechanism includes a ring gear member 15 which is composed of a first ring gear element 15*a* and a second ring gear element 15*b*. The first and second ring gear elements 15*a* and 15*b* are formed in such a manner as to divide a relatively large ring gear including inner and outer toothed portions 18 and 19 into two parts by cutting or milling. Therefore, the first and second ring gear elements 15*a* and 15*b* have essentially the same geometry with regard to the inner and outer teeth. These ring gear elements 15*a* and 15*b* are interconnected by a plurality of connecting pins 17 which are fixed on the second ring gear element 15*b* through the annular hollow defined in the first ring gear element 15*a*. The annular hollow is traditionally filled with elastic materials, such as a cylindrical rubber bushing attached by vulcanizing. Alternatively, as seen in FIG. 1, a plurality of coil springs 16 may be provided in the annular hollow, while the springs 16 are supported by the heads of the connecting pins 17 serving as spring seats. During assembly of the timing pulley 6, the ring gear mechanism, and the sleeve 12, the inner gear 9 of the timing pulley 6 engages the outer toothed portion 19 of the ring gear member 15, while the outer gear 13 of the sleeve 12 engages the inner toothed portion 18 of the ring gear member 15. At least one of the two meshing pairs of teeth (9,19; 13,18) is helical to provide axial sliding movement of the ring gear relative to the camshaft 1. The axially forward movement of the first ring gear element 15*a* is restricted by an inner shoulder 6*a* formed on the inner periphery of the pulley 6 in such a manner that the front end of the first ring gear element 15*a* abuts the shoulder 6*a*. On the other hand, the axially backward movement of the second ring gear element 15*b* is restricted by the front end of a substantially annular retainer 21 which is fixed on the rear end portion of the hub of the pulley 6 by caulking. An annular pressure chamber 20 is defined by the inner peripheral surface of the pulley 6, the outer peripheral surface of the sleeve 12, and the front end surface of the first ring gear element 15*a*, for introducing working fluid fed from the oil pan (not shown) via the engine oil pump (not shown).

In FIG. 1, reference numeral 22 designates a ring gear drive mechanism for activating axial sliding movement of the previously described ring gear member 15. The drive mechanism 22 comprises a hydraulic circuit including an electromagnetic solenoid valve 27 for supplying and draining working fluid from the oil pan (not shown) to the pressure chamber 20 and a compression spring 24 disposed between the second ring gear element 15*b* and the retainer 21 for normally biasing the ring gear member 15 in an axially forward direction. As shown in FIG. 1, the aforementioned hydraulic circuit also includes an oil supply passage 23, an intermediate oil passage 26, and an oil exhaust passage (not shown). The oil supply passage 23 communicates, through the solenoid valve 27, a main oil gallery 25 with an oil pump (not shown) at an upstream end thereof and also communicates at its downstream end with an annular oil passage 28 defined between the outer peripheral surface of the front journalled section of the camshaft 1 and the semi-circular curved surface of the cylinder head 2 and the bearing member 3. The intermediate oil passage 26 includes a radial oil passageway 26a diametrically passing through the front journalled section of the camshaft 1, an axial oil passageway 26b formed in the bolt 14 to communicate with the pressure chamber 20, and an axial oil passageway 26c bored in the front end portion of the camshaft 1 in such a manner as to intercommunicate the oil passage 26a and the oil passage 26b. The solenoid valve 27 is controlled by a control unit (not shown) determining the operating state of the engine on the basis of signals from various sensors, such as a crank angle sensor and an air flow meter.

The intake- and/or exhaust-valve timing control system for internal combustion engines as set forth above, operates as follows.

When the engine is operating under low load, the control signal from the previously described control unit is in an OFF state, with the result that the oil supply from the oil pump (not shown) is blocked by the solenoid valve 27 and the working fluid is returned through the solenoid valve to the oil pan (not shown). As a result, the pressure within the pressure chamber 20 becomes low, and therefore the ring gear member 15 is positioned at the leftmost position (viewing FIG. 1) by the spring 24. In this condition, the relative phase angle between the timing pulley 6 and the camshaft 1 is set to a predetermined phase angle in which an intake- and/or exhaust-valve timing relative to the crank angle is initialized.

Conversely, when the operating state of the engine is changed from a low load to a high load, the control signal from the control unit is output to the solenoid 27 with the result that working fluid is supplied from the oil pump through the oil supply passage 23 and the intermediate oil passage 26 to the pressure chamber 20. As a result, since the pressure of the working fluid within the pressure chamber 20 becomes high, the ring gear member 15 is moved in the right direction (viewing FIG. 1) against the spring force generated by the spring 24. Therefore, the phase angle between the pulley 6 and the camshaft 1 is changed to a predetermined phase angle which corresponds to an optimal phase angle during high engine load conditions. In this manner, the intake- and/or exhaust-valve timing is variably controlled dependent upon the operating state of the engine.

FIG. 2 is a schematic view illustrating an engaging state wherein the three members, namely the pulley 6, the sleeve 12, and the ring gear member 15 are approximately and initially assembled as a unit. As is well known, timing marks are traditionally indicated on the top of each predetermined tooth of the timing pulley 6 and the sleeve 12 of the camshaft. However, in the manufacturing process of the previously described three members, the outer gear 11 of the pulley, the outer toothed portion 19 of the ring gear member, and the outer gear 13 of the sleeve, are independently formed irrespective of the phase angles of the inner gear 9, the inner gear 18, and the engaging groove 12a, to facilitate ease of manufacture. In other words, the relative phase angle relationship between the associated engaging portions formed on each of the three members is random.

As shown in FIG. 2, the top of a tooth 11a of the outer gear 11, which may be marked by a timing mark preferably in the vicinity of a datum line x at the time of installation, is ordinarily offset from the datum line x due to the random phase angle relationship discussed above. Additionally, the top of a tooth 13a of the outer gear 13, is also ordinarily offset from the datum line x and may also be marked by a timing mark in the vicinity of the datum line. The datum line x is drawn from the center of the camshaft 1 to the center of the knock pin 5, and is temporarily utilized for the purpose of easy and precise phase angle adjustments. Note that the relative phase angle relationship between the camshaft 1 and the sleeve 12 is determined by the engagement of the knock pin 5 press-fitted into the knock pin hole 4 of the camshaft 1 and the engaging groove 12a of the sleeve 12. For example, after approximate assembly of the camshaft 1, the pulley 6 and the ring gear member 15, assume that the top of a tooth 13a of the outer gear 13 of the sleeve to be marked by the timing mark is offset by $+0.5°$ from the datum line x, and the top of tooth 11a of the pulley to be marked by the timing mark is offset by $-0.5°$ from the datum line x, the offset angle between the tops of the two teeth being $+0.5°-(-0.5°)=1.0°$. The above mentioned top of tooth 11a is selected in the vicinity of the datum line x in either of two directions, namely clockwise or counterclockwise and may be marked by a timing mark for temporary reference. On the other hand, the timing mark of the top of tooth 13a of the outer gear 13 will mark the final timing position and is therefore selected in as close proximity to the datum line x as possible.

If the previously described tops of teeth 116a and 13a, defining the offset angle of 1.0° were selected as final points to be marked by the timing marks, the relatively large offset angle would adversely affect the preset intake- and/or exhaust-valve timing relative to the crank angle. The intake- and/or exhaust-valve timing must be set within a predetermined tolerance, for example $\pm 0.5°$. Therefore, an operation to adjust the offset angle of the tops of the teeth marked by timing marks is required to bring the offset angle within the predetermined tolerance. For this reason, the valve timing control system according to the invention is designed so that the outer gear 11 of the pulley 6 has a first number of teeth and the outer gear 13 of the sleeve 12 has a second number of teeth different from the first number, and in addition the combination of the first and second numbers of teeth is selected in such a manner as to satisfy the following inequality.

$$|(O_1-O_2)+n(360°/M)| \leqq |T|$$

wherein $O_1$ is the offset angle of the temporarily selected top of tooth 11a of the outer gear 11 of the pulley 6 from the datum line x, $O_2$ is the offset angle of the selected top of tooth 13a of the outer gear 13 of the sleeve 12 from the datum line x, n is an integer, M is the least common multiple between the first and second numbers of teeth, and T is the predetermined tolerance of the intake- and/or exhaust-valve timing. In the above inequality, $(O_1-O_2)$ is representative of an offset angle of an intake- and/or exhaust-valve timing of the engine in a state wherein the camshaft 1, the pulley 6 and the ring gear member 15 are temporarily assembled, while 360°/M is representative of the finest possible adjustable angle. Therefore, it is desirable that a combination of the first and second numbers of teeth is selected such that the least common multiple M satisfies an inequality $360°/M \leqq |T|$. Preferably, at least one of the first and second numbers should be a prime number. If the first number is equal to the second number, M is also equal to the second number. In this case, the second number itself must be selected to be a considerably large number, for example 360 teeth, to provide a least common multiple M as large as possible. Such a large number of teeth however, is impossible with regard to machining. Therefore, in the valve timing control system according to the invention, the first number of teeth is selected in such a manner as to be different from the second number. The number of teeth on each of the pulley 6 and the sleeve 12 is so selected that the adjustment between the top of selected tooth 11*a* of the outer gear 11 and the top of selected tooth 13*a* of the outer gear 13 may be made to bring the pulley 6 and the sleeve 12 into an angular relationship which is within an allowable tolerance. Adjustment of the relative angles is done by withdrawing the camshaft 1, with the sleeve 12 attached, from the temporary assembly and reinserting same after offsetting it by a determined number of teeth relative the ring gear 15; thus, the tooth 13*a* is also angularly offset from tooth 11*a*. In this manner, the angular relationship between the pulley 6 and the sleeve 12 is brought within the allowable tolerance in a manner which satisfies the following inequality.

$$|(P_1 \times Z_1 + O_1) - (P_2 \times Z_2 + O_2)| \pm |T|$$

wherein $P_1$ is a phase an angle corresponding to one pitch of adjacent teeth of the outer gear 11, $Z_1$ is a number of teeth calculated clockwise from the top of selected tooth 11*a* of the outer gear 11 which corresponds to a phase angle resulting from offsetting the angular orientation of the tooth 13*a* of the outer gear 13 by a number of teeth required to bring the angular relationship between the pulley 6 and the sleeve 12 within the required tolerance, $O_1$ and $O_2$ are the previously described offset angles, $P_2$ is a phase angle corresponding to one pitch of adjacent teeth of the outer gear 13, $Z_2$ is a number of teeth calculated clockwise from the top of selected tooth 13*a* of the outer gear 13 which the selected tooth 13*a* must be offset to bring the angular relationship between the pulley 6 and the sleeve 12 with the required tolerance, and T is the previously described tolerance. In the present embodiment, the first and second numbers of teeth are set to 50 for the pulley 6, and 29 for the sleeve 12.

Necessarily, the inner toothed portion 18 of the ring gear member 15, engaging the outer gear 13, is so designed as to include the second number of teeth. As previously described, assuming that the offset angles $O_1$ and $O_2$ are −0.5° and +0.5°, respectively, the optimal combination of $Z_1$ and $Z_2$ is easily determined by calculating means, such as a computer so as to satisfy the above described inequality. In the described embodiment, the values of $Z_1$ and $Z_2$ and a final offset angle $O_f$ between the top of tooth 11*a* of the outer gear 11 the top of tooth 13*a* of the outer gear 13 are as follows:

TABLE 1

| $Z_1$ | $Z_2$ | $O_f$ |
|---|---|---|
| 7 | 4 | −0.255° |
| 14 | 8 | +0.490° |
| 26 | 15 | −0.007° |
| 45 | 26 | +0.241° |

As clearly seen in FIG. 2, in the combination where $Z_1=7$ and $Z_2=4$, when the sleeve 12 is reinserted in such a manner as to be offset clockwise with regard to the subassembly of the pulley 6 and the ring gear member 15 by 4 pitches, which corresponds to 49.655° (roughly 7 pitches of the gear 11 of the pulley 6), the final offset angle $O_f$ is −0.255°, well within the allowable tolerance. Under this condition, the relative phase angle between the pulley 6 and the sleeve 12 is set to −0.255°. In this manner, phase angle adjustment may be easily and precisely executed, since the optimal combination of $Z_1$ and $Z_2$ relative to various offset angles $O_1$ and $O_2$ can be easily predetermined by a computer. As appreciated from the above described Table 1, when the offset angles $O_1$ and $O_2$ are −0.5° and +0.5° respectively, the combination of $Z_1=26$ and $Z_2=15$ provides the lowest possible phase angle.

Although in the embodiment, the number of teeth of the outer gear 11 of the pulley 6 and the outer gear 13 of the sleeve 12 are set to first and second numbers satisfying the previously described necessary and sufficient condition, the numbers of teeth of the outer gear 11 and the outer toothed portion 19 of the ring gear member 15 may alternatively be set to the first and second numbers. In this case, to obtain an optimal combination between a tooth 11*a* of the outer gear 11 of the pulley 6 and a tooth of the outer toothed portion 19 of the ring gear member 15 according to the phase angle adjusting procedure as previously described, the subassembly of the sleeve 12 and the ring gear member 15 may be offset and reinserted in such a manner as to offset the ring gear 15 clockwise with regard to the pulley 6.

Furthermore, a cam sprocket and timing chain may be used as an engine torque transmitting member rather than a timing pulley and timing belt.

Moreover, although in the embodiment, the determined tolerance for intake- and/or exhaust-valve timing is selected within a range of ±0.5°, other tolerances may be suitably selected depending on various engine characteristics.

While the foregoing is a description of the preferred embodiments for carrying out the invention, it will be understood that the invention is not limited to the particular embodiments shown and described herein, but may include variations and modifications without departing from the scope or spirit of this invention as described by the following claims.

What is claimed is:

1. An intake- and/or exhaust-valve timing control system for an internal combustion engine comprising:

a substantially cylindrical rotating member having a driven connection with a crankshaft of the engine through an outer toothed portion employed at the outer peripheral surface thereof, the outer toothed portion having a first number of teeth, said rotating member including an inner toothed portion at the inner peripheral surface thereof;

a camshaft including an outer toothed portion having a second number of teeth different from said first number at the outer peripheral surface thereof;

a ring gear member disposed between said camshaft and said rotating member for varying the phase angle between said camshaft and said rotating member, said ring gear member including inner and outer toothed portions being respectively meshed with the outer toothed portion of said camshaft and the inner toothed portion of said rotating member, at least one of the two meshing pairs of toothed portions being helical; and a combination of said first and second numbers being selected in such a manner as to satisfy an inequality $|dO+n(360°/M)| \pm |T|$, wherein dO is an offset angle of intake- and/or exhaust-valve timing of the engine in a state wherein said rotating member, said camshaft and said ring gear member are temporarily assembled such that a first timing mark marked on a tooth of the outer toothed portion of said rotating member and a second timing mark marked on a tooth of the outer toothed portion of said camshaft become in close proximity to each other, so that said offset angle is measured as an offset angle between said first and second timing marks, said first timing mark being marked as a temporary timing mark for temporary reference, said second timing mark being marked as a final timing mark, n is a minus integer and is properly selected, M is the least common multiple between said first and second numbers of teeth, and T is a predetermined tolerance for intake- and/or exhaust-valve timing.

2. The intake- and/or exhaust-valve timing control system as set forth in claim 1, wherein at least one of said first and second numbers is a prime number.

3. The intake- and/or exhaust-valve timing control system as set forth in claim 1, further comprising:

a ring gear drive mechanism for drivingly controlling said ring gear member via oil pressure depending upon the operating state of the engine.

4. An intake- and/or exhaust-valve timing control system for an internal combustion engine comprising:

a substantially cylindrical rotating member having a driven connection with a crankshaft of the engine through an outer toothed portion employed at the outer peripheral surface thereof, said outer toothed portion having a first number of teeth, said rotating member including an inner toothed portion at the inner peripheral surface thereof;

a camshaft including an outer toothed portion at the outer peripheral surface thereof;

a ring gear member disposed between said camshaft and said rotating member for varying the phase angle between said camshaft and said rotating member, said ring gear member including inner and outer toothed portions being respectively meshed with the outer toothed portion of said camshaft and the inner toothed portion of said rotating member, at least one of the two meshing pairs of toothed portions being helical, the outer toothed portion of said ring gear member having a second number of teeth different from said first number; and a combination of said first and second numbers being selected in such a manner as to satisfy an inequality $|dO+n(360°/M)| \leqq |T|$, wherein dO is an offset angle of intake- and/or exhaust-valve timing of the engine in a state wherein said rotating member, said camshaft and said ring gear member are temporarily assembled such that a first timing mark marked on a tooth of the outer toothed portion of said rotating member and a second timing mark on a tooth of the outer toothed portion of said camshaft become in close proximity to each other, so that offset angle is measured as an offset angle between said first and second timing marks, said first timing mark being marked as a timing mark for temporary reference, said second timing mark being marked as a final timing mark, n is a minus integer and is properly selected, M is the least common multiple between said first and second numbers of teeth, and T is a predetermined tolerance for intake- and/or exhaust-valve timing.

5. The intake- and/or exhaust-valve timing control system as set forth in claim 4, wherein at least one of said first and second numbers is a prime number.

6. The intake- and/or exhaust-valve timing control system as set forth in claim 4, further comprising:

a ring gear drive mechanism for drivingly controlling said ring gear member via oil pressure depending upon the operating state of the engine.

7. An intake- and/or exhaust-valve timing control system for an internal combustion engine comprising:

a substantially cylindrical rotating member having a driven connection with a crankshaft of the engine through an outer toothed portion employed at the outer peripheral surface thereof, the outer toothed portion having a first number of teeth, said rotating member including an inner toothed portion at the inner peripheral surface thereof;

a camshaft including an outer toothed portion having a second number of teeth different from said first number at the outer peripheral surface thereof;

a ring gear member disposed between said camshaft and said rotating member for varying the phase angle between said camshaft and said rotating member, said ring gear member including inner and outer toothed portions being respectively meshed with the outer toothed portion of said camshaft and the inner toothed portion of said rotating member, at least one of the two meshing pairs of toothed portions being helical; and a combination of said first and second numbers being selected in such a manner as to satisfy an inequality $360°/M \leqq |T|$, wherein M is the least common multiple between said first and second numbers of teeth, and T is a predetermined tolerance for intake- and/or exhaust-valve timing.

8. An intake- and/or exhaust-valve timing control system for an internal combustion engine comprising:

a substantially cylindrical rotating member having a driven connection with a crankshaft of the engine through an outer toothed portion employed at the outer peripheral surface thereof, said outer toothed portion having a first number of teeth, said rotating member including an inner toothed portion at the inner peripheral surface thereof;

a camshaft including an outer toothed portion at the outer peripheral surface thereof;

a ring gear member disposed between said camshaft and said rotating member for varying the phase angle between said camshaft and said rotating member, sand ring gear member including inner and outer toothed portions being respectively meshed with the outer toothed portion of said camshaft and the inner toothed portion of said rotating member, at least one of the two meshing pairs of toothed portions being helical, the outer toothed portion of said ring gear member having a second number of teeth different from said first number; and a combination of said first and second numbers being selected in such a manner as to satisfy an inequality $360°/M \leqq |T|$, wherein M is the least common multiple between said first and second numbers of teeth, and T is a predetermined tolerance for intake- and/or exhaust-valve timing.

9. A process for assembling three components in an intake- and/or exhaust-valve timing control system for an internal combustion engine, said three components including:

a substantially cylindrical rotating member having a driven connection with a crankshaft of the engine through an outer toothed portion employed at the outer peripheral surface thereof, the outer toothed portion having a first number of teeth, said rotating member including an inner toothed portion at the inner peripheral surface thereof;

a camshaft including an outer toothed portion having a second number of teeth different from said first number at the outer peripheral surface thereof;

a ring gear member disposed between said camshaft and said rotating member for varying the phase angle between said camshaft and said rotating member, said ring gear member including inner and outer toothed portions being respectively meshed with the outer toothed portion of said camshaft and the inner toothed portion of said rotating member, at least one of the two meshing pairs of toothed portions being helical; said assembling process comprising the steps of:

(a) determining a tolerance for intake- and/or exhaust-valve timing;

(b) selecting said first and second numbers in such a manner as to satisfy an inequality $360°/M \leqq |T|$, wherein T is said predetermined tolerance for intake- and/or exhaust-valve timing and M is the least common multiple between said first and second numbers of teeth;

(c) temporarily assembling said rotating member, said camshaft and said ring gear member such that a first timing mark marked on a tooth of the outer toothed portion of said rotating member and a second timing mark marked on a tooth of the outer toothed portion of said camshaft become in close proximity to each other, said first timing mark being marked as a timing mark for reference, said second timing mark being marked as a final timing mark;

(d) measuring an offset angle between said first and second timing marks;

(e) deriving a combination of a number of teeth calculated in a rotational direction of said rotating member from the tooth marked by said first timing mark and a number of teeth calculated in a rotational direction of said camshaft from the tooth marked by said timing mark, in such a manner as to satisfy an inequality $|dO+(P_1 \times z_1)-(P_2 \times z_2) \leqq |T|$, wherein dO is said offset angle corresponding to an offset angle of intake- and/or exhaust-valve timing of the engine, $P_1$ is a phase angle corresponding to one pitch of adjacent teeth of the outer toothed portion of said rotating member, $z_1$ is said calculated number of teeth of said rotating member, $P_2$ is a phase angle corresponding to one pitch of adjacent teeth of the outer toothed portion of said camshaft, $z_2$ is said calculated number of teeth of said camshaft, M is the least common multiple between said first and second numbers of teeth, and T is a predetermined tolerance for intake- and/or exhaust-valve timing;

(f) marking a final timing mark on a tooth offsetting by said calculated number of teeth of said rotating member from the tooth marked by first timing mark; and (g) rotating said camshaft relative to said ring gear member by a phase angle corresponding to said calculated number of teeth of said camshaft.

* * * * *